US006906475B2

(12) United States Patent
Atagi

(10) Patent No.: US 6,906,475 B2
(45) Date of Patent: Jun. 14, 2005

(54) FLUORESCENT LAMP AND HIGH INTENSITY DISCHARGE LAMP WITH IMPROVED LUMINOUS EFFICIENCY

(75) Inventor: Tomoko Atagi, Takatsuki (JP)

(73) Assignee: Matsushita Electric Industrial Co., Ltd., Osaka-Fu (JP)

( * ) Notice: Subject to any disclaimer, the term of this patent is extended or adjusted under 35 U.S.C. 154(b) by 0 days.

(21) Appl. No.: 09/897,230

(22) Filed: Jul. 2, 2001

(65) Prior Publication Data

US 2002/0070682 A1 Jun. 13, 2002

(30) Foreign Application Priority Data

Jul. 7, 2000 (JP) ..... 2000-206487

(51) Int. Cl.[7] ..... H05B 41/16; H01J 1/62
(52) U.S. Cl. ..... 315/246; 315/291; 313/485
(58) Field of Search ..... 315/291, 246, 315/344, 248, 358, 326, DIG. 2; 313/485, 487, 489, 636, 493, 496, 110, 112

(56) References Cited

U.S. PATENT DOCUMENTS

| | | | | |
|---|---|---|---|---|
| 3,602,757 A | | 8/1971 | Wachtel | 313/109 |
| 3,617,357 A | * | 11/1971 | Nagy | 23/305 R |
| 3,670,194 A | | 6/1972 | Thornton, Jr. et al. | 313/109 |
| 3,707,641 A | | 12/1972 | Thornton | 313/109 |
| 4,001,628 A | * | 1/1977 | Ryan | 313/487 |
| 4,038,203 A | | 7/1977 | Takahashi | 252/301.4 |
| 4,079,288 A | * | 3/1978 | Maloney et al. | 313/113 |
| 4,356,428 A | * | 10/1982 | Hanlet | 313/305 |
| 5,118,985 A | | 6/1992 | Patton et al. | 313/485 |
| 5,464,462 A | | 11/1995 | Langer et al. | 65/66 |
| 5,528,107 A | | 6/1996 | Marlor et al. | 313/636 |
| 5,552,665 A | * | 9/1996 | Trushell | 313/112 |
| 5,602,444 A | * | 2/1997 | Jansma | 313/489 |
| 5,604,396 A | * | 2/1997 | Watanabe et al. | 313/485 |
| 5,666,031 A | * | 9/1997 | Jennato et al. | 313/637 |
| 5,726,528 A | * | 3/1998 | Jansma et al. | 313/489 |
| 5,801,483 A | * | 9/1998 | Watanabe et al. | 313/485 |
| 5,869,927 A | * | 2/1999 | Matsuo et al. | 313/485 |
| 5,961,883 A | | 10/1999 | Yamazaki et al. | 252/301.4 F |
| 6,018,216 A | | 1/2000 | McIntosh | 313/315 |
| 6,348,763 B1 | * | 2/2002 | Collins | 313/634 |
| 6,583,566 B1 | * | 6/2003 | Jin et al. | 313/637 |

FOREIGN PATENT DOCUMENTS

| | | |
|---|---|---|
| DE | 31 28 649 A1 | 2/1983 |
| EP | 921554 | 6/1999 |
| EP | 0921 554 A1 | 6/1999 |
| GB | 2167 428 A | 5/1986 |
| JP | 49-99610 | 9/1974 |
| JP | 52-142710 | 11/1977 |
| JP | 6-196127 | 7/1994 |
| JP | 8-325031 | 12/1996 |
| JP | 10167755 | 6/1998 |
| JP | 11167899 | 6/1999 |

* cited by examiner

*Primary Examiner*—Don Wong
*Assistant Examiner*—Chuc Tran

(57) ABSTRACT

The present invention improves the luminous efficiency of lamps that emit light due to electric discharge, such as a fluorescent lamp and an HID lamp. The fluorescent lamp includes a glass tube used as a fluorescent tube made of a glass material containing an emissive element. When exposed to ultraviolet light (with the peak wavelength of 251 nm) emitted due to mercury excitation, the emissive element emits ultraviolet light having a longer wavelength than that. The HID lamp includes an envelop made of a glass material that contains an emissive element. When exposed to ultraviolet light emitted due to excitation of an emissive material enclosed in an arc tube, the emissive element emits ultraviolet light having a longer wavelength than that.

23 Claims, 11 Drawing Sheets

FLUORESCENT LAMP AND HIGH INTENSITY DISCHARGE LAMP WITH IMPROVED LUMINOUS EFFICIENCY

BACKGROUND OF THE INVENTION (1) Field of the Invention

The present invention relates to a fluorescent lamp and a high intensity discharge lamp.

(2) Related Art

Fluorescent lamps and high intensity discharge (HID) lamps are widely known to emit light with high efficiency.

A fluorescent lamp includes an arc tube in which mercury and a rare gas are enclosed. The inner surface of the arc tube is coated with phosphors. The electric discharge performed in the arc tube excites mercury to emit ultraviolet light with the dominant wavelength of 254 nm. The ultraviolet light excites the phosphors to emit visible light. In this way, a luminous flux can be obtained. Typical fluorescent lamps of this type have conventionally been straight tube type fluorescent lamps and circular fluorescent lamps, with bulb-type fluorescent lamps and compact fluorescent lamps being widely introduced in recent years.

An HID lamp is the generic name for a high-pressure mercury lamp, a metal halide lamp, and a high-pressure sodium lamp.

The high-pressure mercury lamp emits light due to the electric discharge under mercury vapor of 100 to 100 kPa.

The metal halide lamp emits light as follows. With the electric discharge, metal halide is dissociated into metallic atoms and halide atoms. The metallic atoms are then excited to emit visible light.

The high-pressure sodium lamp emits light due to the electric discharge under sodium vapor.

As basic performances of these fluorescent lamps and HID lamps, obtaining a larger luminous flux with lower electric power consumption and achieving a long lifetime are pursued. Active research and development have been made for accomplishing these basic performances.

As one example, Japanese Laid-Open Patent Application No. H11-167899 discloses a technique for lengthening a lifetime of a fluorescent lamp. According to the disclosure, the luminous intensity of a conventional fluorescent lamp employing soda glass is likely to decrease because sodium is eluted from the soda glass at the time the fluorescent lamp is manufactured or lit, and the eluted sodium reacts with mercury. In view of this, the fluorescent lamp according to the technique employs such glass from which sodium is less likely to be eluted than the conventional soda glass, for preventing the luminous intensity from decreasing.

Also, to obtain a larger luminous flux of a fluorescent lamp with lower electric power consumption, for example, research and development have been made to improve luminance of phosphors, and to secure a long arc length by making an arc tube thinner.

These research and development have contributed to improving the performances of fluorescent lamps and HID lamps to some extent. However, there are increasing demands for further improving these performances in recent years. To meet these demands, techniques for further decreasing the electric power consumption and providing larger luminous flux are called for.

SUMMARY OF THE INVENTION

The present invention aims to improve the luminous efficiency of lamps that emit light due to the electric discharge, such as a fluorescent lamp and an HID lamp.

In view of the above object, the fluorescent lamp of the present invention includes, as a fluorescent tube, a glass tube made of a glass material containing an emissive element. When exposed to the ultraviolet light (with the peak wavelength of 254 nm) emitted by mercury excitation, the emissive element emits ultraviolet light with a longer wavelength.

Alternatively, the fluorescent lamp of the present invention includes a glass tube whose inner surface is covered with a protective layer containing the above mentioned emissive element. On the protective layer made of metallic oxide as its base material, a phosphor layer is formed.

According to the fluorescent lamp of the present invention, the electric discharge under mercury vapor in the fluorescent tube produces ultraviolet light with the peak wavelength of 254 nm. This ultraviolet light illuminates the emissive element to emit long wave ultraviolet light, and visible light. This long wave ultraviolet light excites the phosphor layer to emit secondary visible light. With this effect, the utilization efficiency of the ultraviolet light emitted by mercury excitation for the luminous flux of the fluorescent lamp is improved. As a result of this, the total amount of the luminous flux can be increased by at least 2%, compared to a conventional lamp without the emissive element. To improve the visible light transmission rate of the glass tube or the protective layer, it is preferable to melt the emissive element into a glass material that forms the glass tube, or into metallic oxide that is the base material of the protective layer.

Also, the HID lamp of the present invention includes an envelop made of a glass material containing the above mentioned emissive element. When exposed to the ultraviolet light emitted by excitation of an emissive material enclosed inside an arc tube, the emissive element is excited to emit ultraviolet light with a longer wavelength.

As the emissive elements to be contained in the glass for use in the fluorescent lamp and in the HID lamp, it is preferable to use oxides of the below listed elements.

The elements are:

Ti, Zr, V, Nb, Ta, Mo, W, Tl, Sn, Pb, Bi, La, Ce, Pr, Nd, Sm, Eu, Gd, Tb, Dy, Ho, Er, Tm, Yb, and Lu.

The present invention can also be applied to an incandescent lamp. In the incandescent lamp, a bulb is made to contain an emissive element selected from the above, so that the utilization efficiency of light emitted due to the electric discharge, for the luminous flux of the incandescent lamp can be improved.

BRIEF DESCRIPTION OF THE DRAWINGS

These and other objects, advantages and features of the invention will become apparent from the following description thereof taken in conjunction with the accompanying drawings that illustrate a specific embodiment of the invention. In the drawings.

DESCRIPTION OF THE PREFERRED EMBODIMENTS

[First Embodiment]

Figure 1:
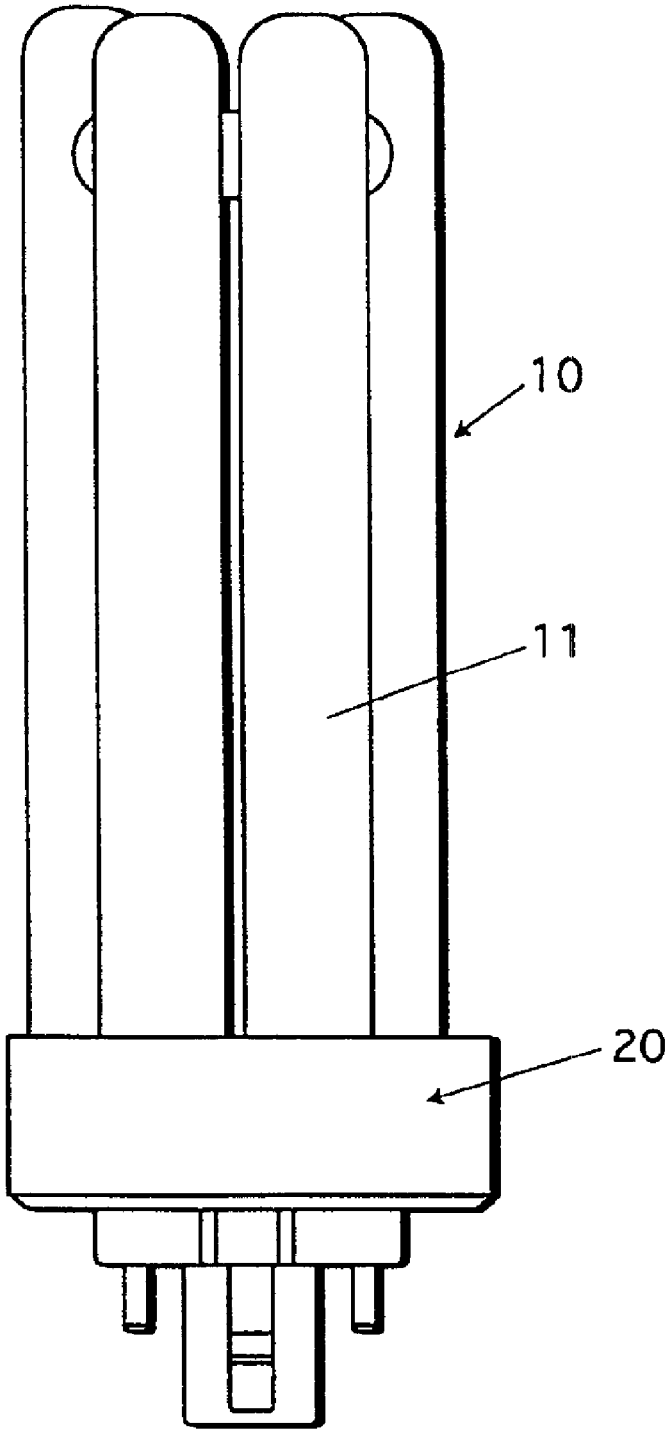
FIG. 1 shows an appearance of a compact fluorescent lamp relating to a first embodiment of the present invention.

FIG. 1 shows an appearance of a compact fluorescent lamp to which the first embodiment of the present invention relates. The compact fluorescent lamp is constructed by a fluorescent tube 10 fixed to a base 20. The fluorescent tube 10 is made up of six straight glass tubes (glass bulbs) 11.

The neighboring glass tubes 11 are bridge-connected so that the six glass tubes 11 are connected with one another to form a single discharge space therein. A rare gas such as argon, and mercury are enclosed inside the discharge space. Also, the fluorescent tube 10 is provided with electrodes (not illustrated) at both ends of the discharge space.

Inside the base 20 is provided an ignition circuit (not illustrated) for igniting the fluorescent tube 10.

Figure 2:
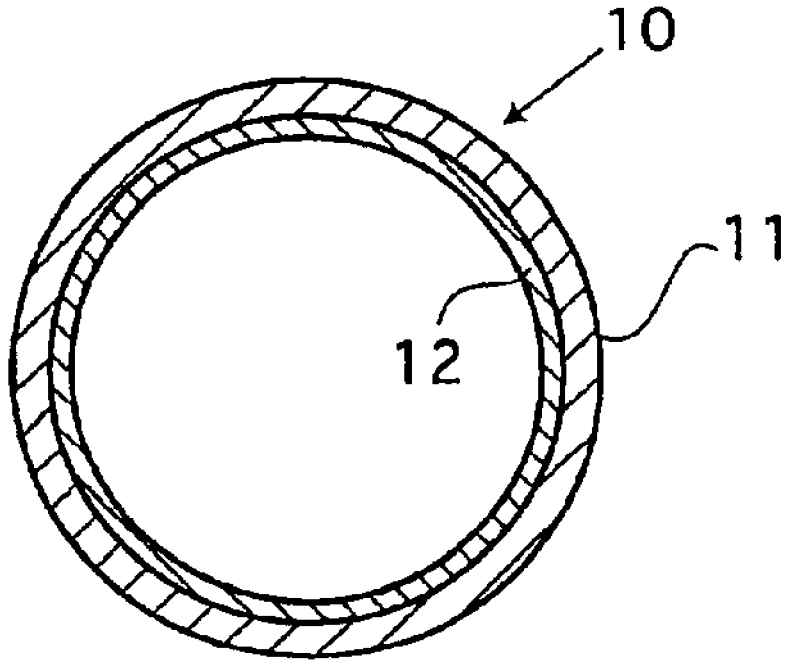
FIG. 2 shows a cross-sectional view of a glass tube constituting a fluorescent tube of the fluorescent lamp.

FIG. 2 shows a cross-sectional view of a glass tube 11 constituting the fluorescent tube 10.

The glass tube 11 is made of soda glass. To be noted is that the soda glass contains an element that is excited to emit light with wavelengths ranging from ultraviolet to visible regions when exposed to ultraviolet light with the wavelength of 254 nm (such an element is hereinafter referred to as an "emissive element").

Examples of emissive elements are oxides of: elements in the groups 4A, 5A, and 6A; elements in the groups 3B, 4B, and 5B; and elements in lanthanoide series.

Specific examples of the elements in the groups 4A, 5A, and 6A are titanium (Ti), zirconium (Zr), vanadium (V), niobium (Nb), tantalum (Ta), molybdenum (Mo), and tungsten (W).

Specific examples of the elements in the groups 3B, 4B, and 5B are thallium (Tl), stannum (Sn), plumbum (Pb), and bismuth (Bi).

Specific examples of the elements in lanthanoide series are lanthanum (La), cerium (Ce), praseodymium (Pr), neodymium (Nd), samarium (Sm), europium (Eu), gadolinium (Gd), terbium (Tb), dysprosium (Dy), holmium (Ho), erbium (Er), thulium (Tm), ytterbium (Yb), and lutetium (Lu).

To form the glass tube 11, a powdered oxide of at least one element selected from the above listed elements is mixed with a soda glass material before melting the soda glass material. This mixed powder is subjected to a melting process and then to a forming process.

The phosphor layer 12 is formed by applying three-band phosphors to the inner surface of the glass tube 11.

Note that a preferable range of the thickness of the glass tube 11 and the phosphor layer 12 will be explained later in this specification.

(Effects)

Figure 3:
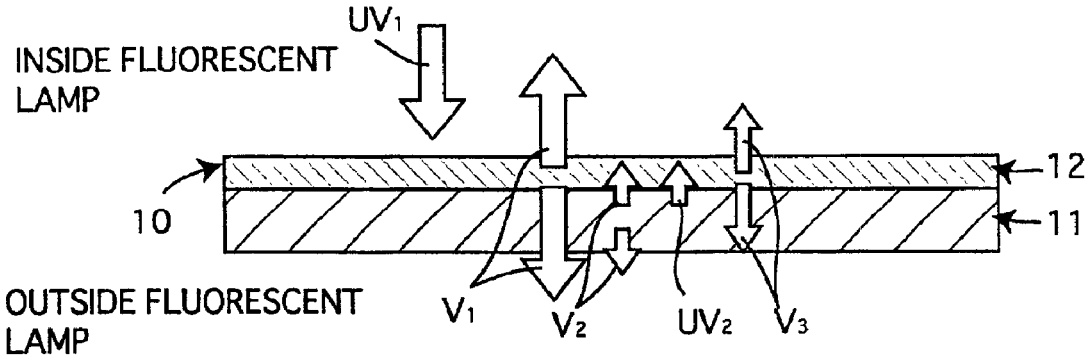
FIG. 3 is for explaining a light emitting mechanism of the fluorescent lamp.

FIG. 3 is for explaining a light emitting mechanism of the above fluorescent lamp.

The fluorescent lamp in the present embodiment produces a luminous flux substantially based on the same mechanism as that of conventional fluorescent lamps. In detail, the ignition circuit applies pressure to the electrodes provided in the fluorescent tube 10, causing electric discharge in the discharge space formed within the fluorescent tube 10. This electric discharge excites mercury and a rare gas enclosed in the discharge space, to produce ultraviolet light "UV1" (with the dominant wavelength of 254 nm). The ultraviolet light "UV1" illuminates the phosphor layer 12, exciting the phosphors to produce visible light "V1" (with a wavelength of approximately 400 nm or more). The visible light "V1" is transmitted through the glass tube 11, forming a chief luminous flux from the fluorescent tube 10.

In addition to this chief luminous flux, the fluorescent lamp of the present invention also emits secondary luminous fluxes (visible light "V2" and visible light "V3") in the following way.

The ultraviolet light "UV1" produced in the fluorescent tube 10 is partially transmitted through the phosphor layer 12 and illuminates the glass tube 11. Here, the glass tube 11 contains an emissive element as explained before. The emissive element is excited with the transmitted portion of the ultraviolet light "UV1" to emit near-ultraviolet light "UV2" (with a wavelength longer than 254 nm), and visible light "UV2" from the glass tube 11.

Furthermore, the near-ultraviolet light "UV2" emitted from the glass tube 11 partially illuminates the phosphor layer 12. This portion of the near ultraviolet light "UV2" excites the phosphors constituting the phosphor layer 12 to emit visible light "V3".

Note here that the emissive element hardly absorbs visible light, and is being uniformly melted in glass that forms the glass tube 11. Accordingly, the emissive element cannot be an obstacle for visible light to be transmitted through the glass tube 11. Therefore, the visible light "V1", "V2", and "V3" are transmitted through the glass tube 11 mostly without being attenuated, to form the luminous flux of the fluorescent lamp.

As described above, the fluorescent lamp in the present invention has the improved luminous efficiency because it produces not only the chief luminous flux (visible light "V1") but also the secondary luminous fluxes (visible light "V2" and "V3") due to the emissive element contained in the glass tube 11.

Also, the glass tube 11 is made of soda glass in which the emissive element is being melted. This is more effective compared to when the glass tube is made of quartz glass in which the emissive element is being melted because the emissive element combined with the soda glass works more effectively to convert ultraviolet light with a wavelength of around 254 nm into long wave ultraviolet light or into visible light.

Here, the concentration of the emissive element to be contained in the glass tube 11 can be considered as follows. If the concentration is too low, the emissive element emits only a small amount of light. On the other hand, if the concentration is too high, the emissive element absorbs ultraviolet light due to its self-absorption property. Taking this balance into account, the concentration of the emissive element should preferably be set in such a range that realizes high luminous efficiency.

Also, the preferable range of the concentration varies depending on the type of the emissive element. For the oxides of the elements in the groups 4A, 5A, and 6A and the elements in lanthanoide series, the concentration should preferably be set in the range of 0.01 to 10 wt % inclusive. For the oxides of the elements in the groups 3B, 4B, and 5B, the concentration should preferably be set in the range of 0.01 to 0.5wt % inclusive.

As indicated by the experimental results which will be described later, a proper amount of emissive element contained in the glass tube 11 enables secondary luminous fluxes (visible light V2 and V3) to be produced at the ratio of 2% or more relative to the total luminous fluxes (visible light V1, V2, and V3).

Note here that the oxides of the elements listed above each have a unique emission spectrum, and differ in various conditions such as its accessibility.

For example, the oxides of the elements in lanthanoide series mostly have emission spectrums with a number of relatively sharp peak wavelengths. The peak wavelengths of the emission spectrums range widely from ultraviolet to visible regions.

On the other hand, the oxides of the elements in the groups 3B, 4B, and 5B have emission spectrums with broad peak wavelengths ranging from 300 to 400 nm. Particularly, thallium oxide (TlO) has high luminous intensity.

Taking these various conditions into account, oxides of one or more suitable elements can be selected from the above listed elements and used as emissive elements when determining the composition of the glass for use as the fluorescent tube. This wide selection of the emissive elements is advantageous because it allows the glass composition of the fluorescent tube to be tailored for its purposes.

In view of improving the luminous efficiency, the oxides of the elements in lanthanoide series, more particularly, oxides of Gd and Tb are suitable for use.

This is because the oxides of these elements have such emission spectrums that are suitable for efficiently exciting fluorescent lamp phosphors.

To be more specific, when a phosphor layer of a fluorescent lamp is illuminated with ultraviolet light, the conversion efficiency of the ultraviolet light into visible light depends on the wavelength of the ultraviolet light. The oxides of these elements emit larger amounts of light having wavelengths in the range of 260 to 400 nm in their emission spectrums. This range is where the conversion efficiency of ultraviolet light exciting general fluorescent lamp phosphors into visible light is favorably high.

Also, the oxides of these elements emit larger amounts of light having wavelengths of around 550 nm, where the sensibility of the human eye is high. Because of this, these emissive elements are considered suitable for improving the luminous efficiency.

(Experiment 1)

Samples No. 2 to No. 6 are compact fluorescent lamps relating to the present embodiment.

There fluorescent lamps used in the experiment each are 145 mm in overall length, with the glass tube diameter of 12.5 mm, and with rated voltage of 32 W.

The fluorescent lamps No. 2 to No. 6 relating to the present embodiment each include the glass tube 11 made of soda glass composed of $SiO_2$ 68 wt %, $Al_2O_3$ 1.5 wt %, $Na_2O$ 5wt %, $K_2O$ 7 wt %, MgO 5 wt %, CaO 4.5 wt %, SrO 5 wt %, BaO 6 wt %, and $Li_2O$ 1 wt %. Note here that TlO was added to this soda glass as an emissive element. The concentration of TlO in the glass tube 11 was set at various values (0.001, 0.01, 0.1, 0.3, and 0.5 wt %) as shown in Table 1.

The phosphor layer 12 was formed by three-band phosphors with the color temperature of 5000K.

The fluorescent lamp No. 1 relating to the comparative experiment has the same construction as the fluorescent lamps relating to the present embodiment except that TlO was not added to the glass tube.

The initial luminous flux value and the luminous flux maintenance factor of these fluorescent lamps relating to the comparative experiment and the present embodiment were measured according to the following measurement method.

Measurement Method:

The initial luminous flux value (100 h, 1 m) is a value obtained by measuring a luminous flux of each fluorescent lamp after a life test of 100 hours.

The luminous flux maintenance factor is a ratio of a luminous flux of each fluorescent lamp measured after a life test of 4000 hours (repeating a 45 minute illumination/15 minutes off cycle) to the above obtained initial luminous flux value.

Measurement Results and Considerations:

The measurement results are shown in Table 1.

Comparing the initial luminous flux values shown in Table 1, the initial luminous flux value of sample No. 2 which contains only 0.001 wt % of TlO is the same as that of sample No. 1 which does not contain TlO. However, the initial luminous flux values of samples No. 3 to No. 6 which respectively contain 0.01 to 0.5 wt % of TlO are higher than that of sample No. 1 by at least 2%. Looking at the luminous maintenance factors of these samples, on the other hand, only subtle differences can be observed.

From this experiment, it can be found that a proper amount of emissive element contained in a glass tube can improve the initial luminous flux value of the fluorescent lamp by at least 2%, without decreasing the luminous flux maintenance factor. It can also be found that it is preferable to set the TlO concentration in the glass tube at 0.01 wt % or more.

(Experiment 2)

TABLE 1

| Sample No. | | 1 | 2 | 3 | 4 | 5 | 6 |
|---|---|---|---|---|---|---|---|
| Composition | TlO (wt %) | 0 | 0.001 | 0.01 | 0.1 | 0.3 | 0.5 |
| Characteristics | Initial Luminous Flux Value (100 h), 1 m | 2300 | 2300 | 2350 | 2450 | 2480 | 2500 |
| | Luminous Flux Maintenance Factor (4000 h), % | 75.5 | 75.6 | 76 | 75.8 | 75.5 | 76 |

Sample No. 1 shown in Table 1 above is a compact fluorescent lamp relating to a comparative example.

The emission spectrum of the soda glass which contains 0.3 wt % of TlO used for sample No. 5 relating to the present embodiment and the emission spectrum of the soda glass used for sample No. 1 relating to the comparative example, when exposed to ultraviolet light with the wavelength of 254 nm, were measured according to the following measurement method.

Figure 4:
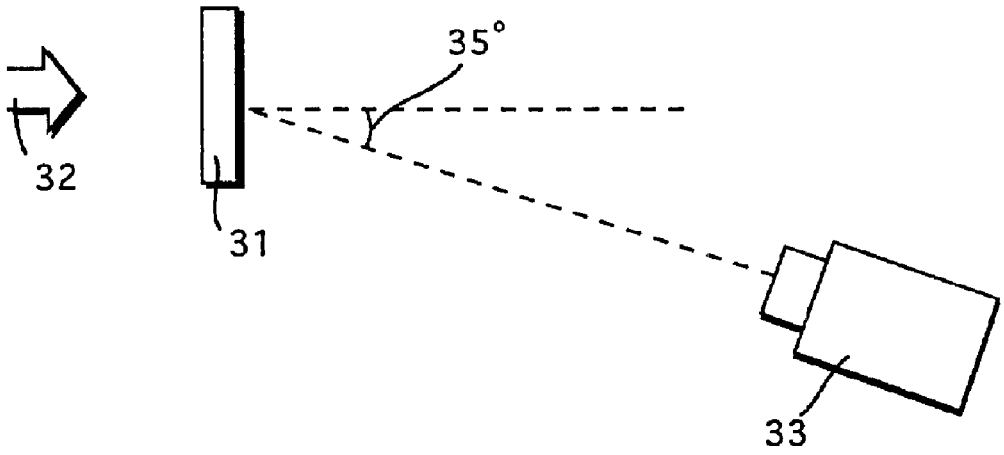
FIG. 4 shows a measurement method of an emission spectrum in Experiment 2.

Measurement Method:

A test piece of each soda glass with the thickness of 2 mm and each side length of 20 mm was prepared. As shown in FIG. 4, each test piece 31 was illuminated with excitation light 32 having the wavelength of 254 nm with the incident radiation intensity of 0.4 $mW/cm^2$. The emission spectrum from the test piece 31 was measured using an instantaneous spectroscope 33.

Figure 5:
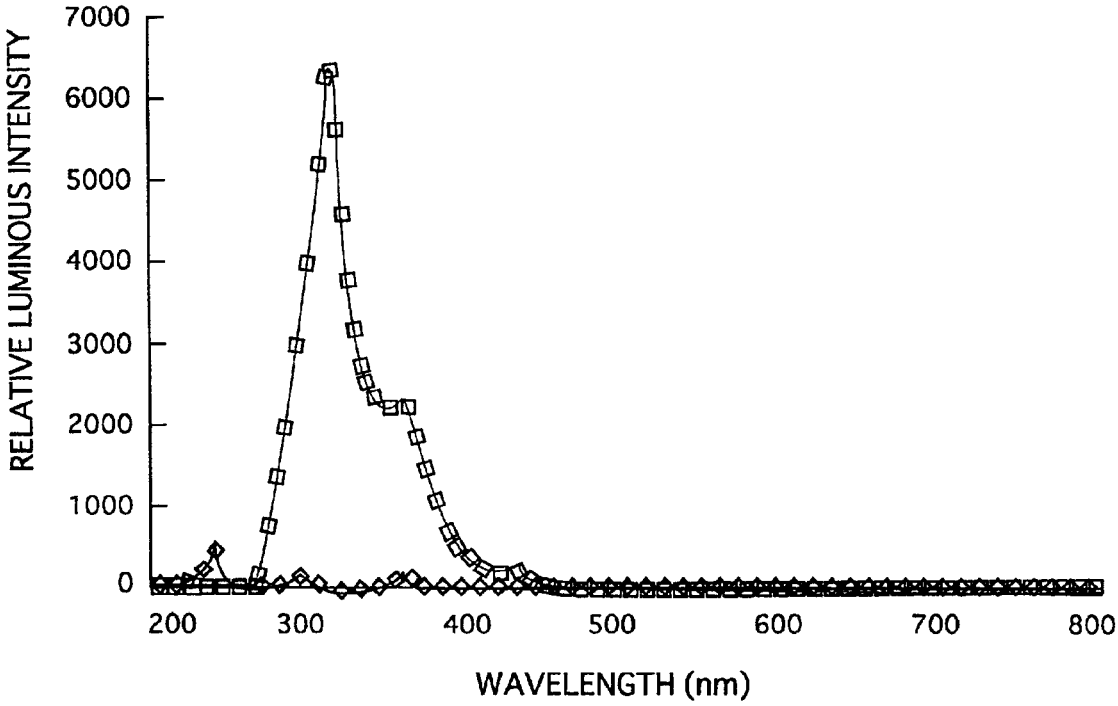
FIG. 5 shows the emission spectrum resulting from Experiment 2.

Measurement Results and Considerations:

The measurement results are shown in FIG. 5. In the figure, each mark ◇ indicates the measurement result of sample No. 1, and each mark □ indicates the measurement result of sample No. 5.

As can be seen from the measurement results shown in FIG. 5, sample No. 1 which does not contain TlO emits little light having wavelengths longer than 254 nm, whereas sample NO. 5 which contains 0.3 wt % of TlO emits light having broad wavelengths ranging from 315 nm as its peak to a visible region of around 450 nm.

As explained using FIG. 3 above, the following can be proved by these measurement results. By illuminating glass containing TlO with ultraviolet light "UV1" having the peak wavelength of 254 nm, excited ultraviolet light "UV2" and excited visible light "UV2" are produced.

Note that although TlO was used as the emissive element in Experiments 1 and 2, experiments where the other oxides of the elements listed above were used as emissive elements were also conducted. In these experiments, the similar results as Experiments 1 and 2 were obtained.

Also, the optimum range of the concentration of each element to be contained was examined and determined as follows. For the oxides of the elements in the groups 4A, 5A, and 6A and the elements in lanthanoide series, the optimum range is 0.01 to 10 wt %. For the oxides of the elements in the groups 3B, 4B, and 5B, the optimum range is 0.01 to 0.5 wt %.

(Experiment 3) Experiment and Considerations for Glass Thickness

The experiment was conducted to examine the visible light transmission rate of soda glass plates which each contain 0.3 wt % of emissive element (TlO) but each vary in the thickness.

Figure 6:
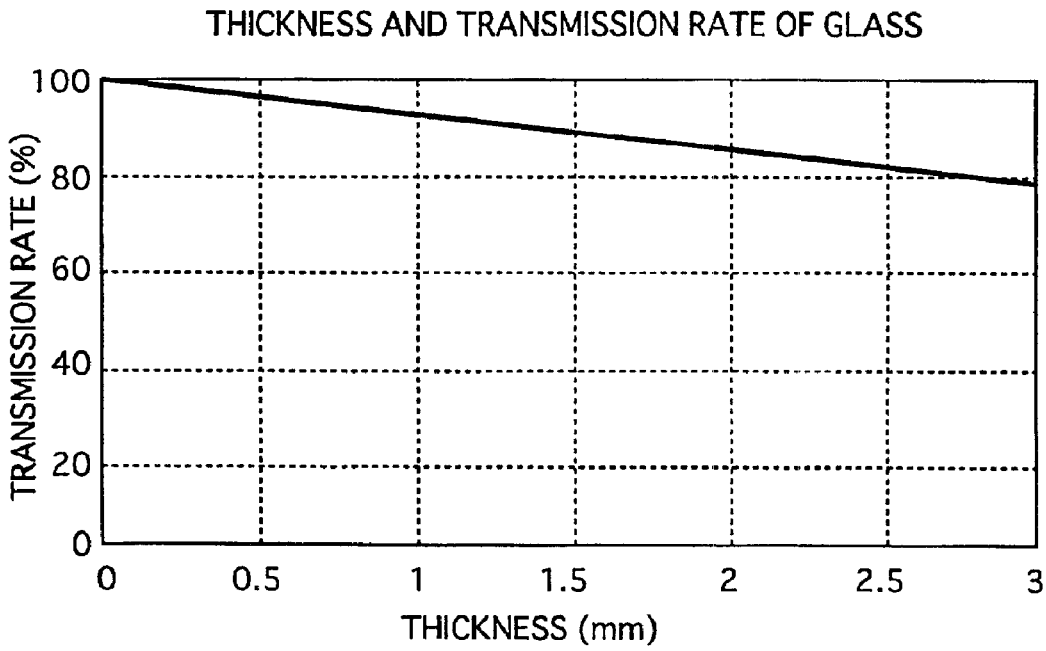
FIG. 6 is a characteristic graph showing the relation between glass plate thickness and visible light transmission rate, resulting from Experiment 3.

FIG. 6 shows a characteristic graph showing the results of this experiment. From the figure, it can be found that the transmission rate decreases as the thickness of the glass plate increases.

Also, the relative luminous intensity of glass tubes each composed of a glass material containing 0.3 wt % of TlO with the fixed diameter of 12.5 mm, but each with the thickness being made varied was examined.

Figure 7:
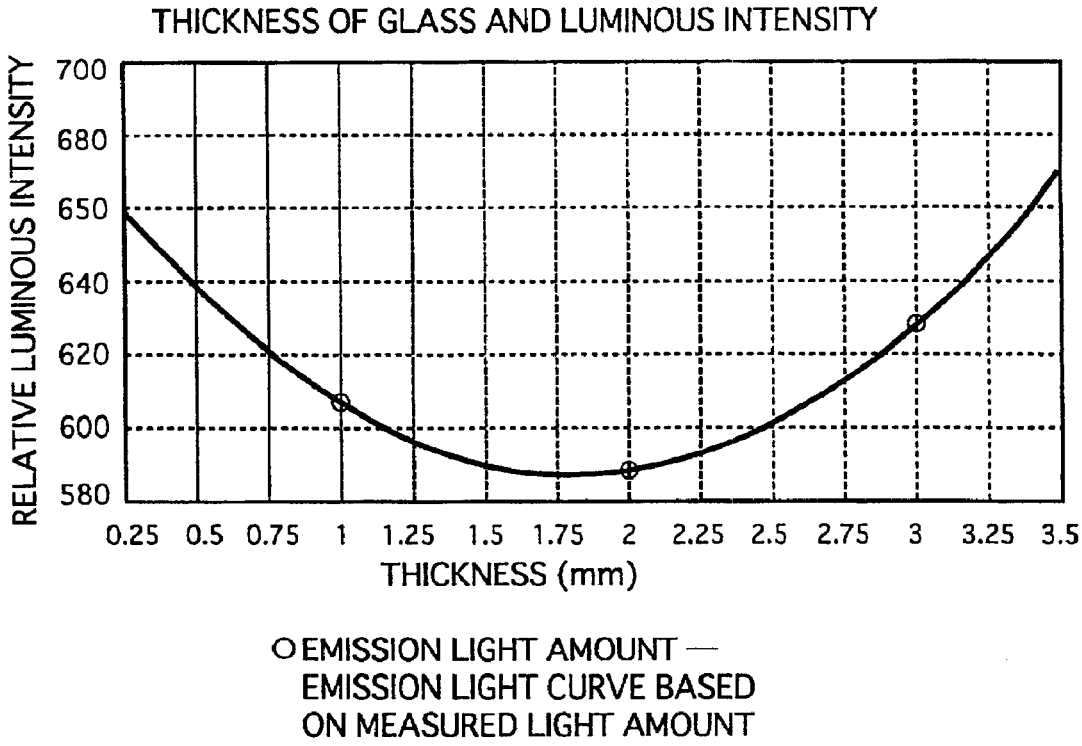
FIG. 7 is a characteristic graph showing the relation between glass tube thickness and relative luminous intensity.

FIG. 7 shows a characteristic graph written based on the results of this experiment. In the figure, marks ○ indicate the measured relative luminous intensity when the thickness of the glass tube is set relatively at 1, 2, and 3 mm. In the graph, the curve indicates the relation between the thickness of the glass tube and the relative luminous intensity estimated based on these measured values. From the figure, it can be found that the relative luminous intensity decreases as the thickness of the glass tube increases when the thickness of the glass tube is relatively small, that is, 1.5 mm or less.

To sum up, making the glass tube containing an emissive element thinner, both the transmission rate and the relative luminous intensity can be improved. In view of this, for increasing the relative luminous intensity of the fluorescent lamp relating to the present embodiment, the thickness of the glass tube 11 is to be set smaller.

Known from these experiments are as follows. While glass tubes with the thickness of above 0.62 mm are used as arc tubes for conventional general fluorescent lamps, it is advantageous for the fluorescent lamp relating to the present embodiment to set the thickness of the glass tube 11 at 0.62 mm or less.

(Experiment 4) Experiment and Considerations Regarding Phosphor Layer Thickness

The relative luminous intensity of a fluorescent lamp employing glass which contains 0.3 wt % of an emissive element (TlO) and the relative luminous intensity of a fluorescent lamp employing conventional soda glass which does not contain the emissive element were measured, in the case where the thickness of the phosphor layer in each fluorescent lamp is made varied in the range of 0 to 40 $\mu$m.

Figure 8:
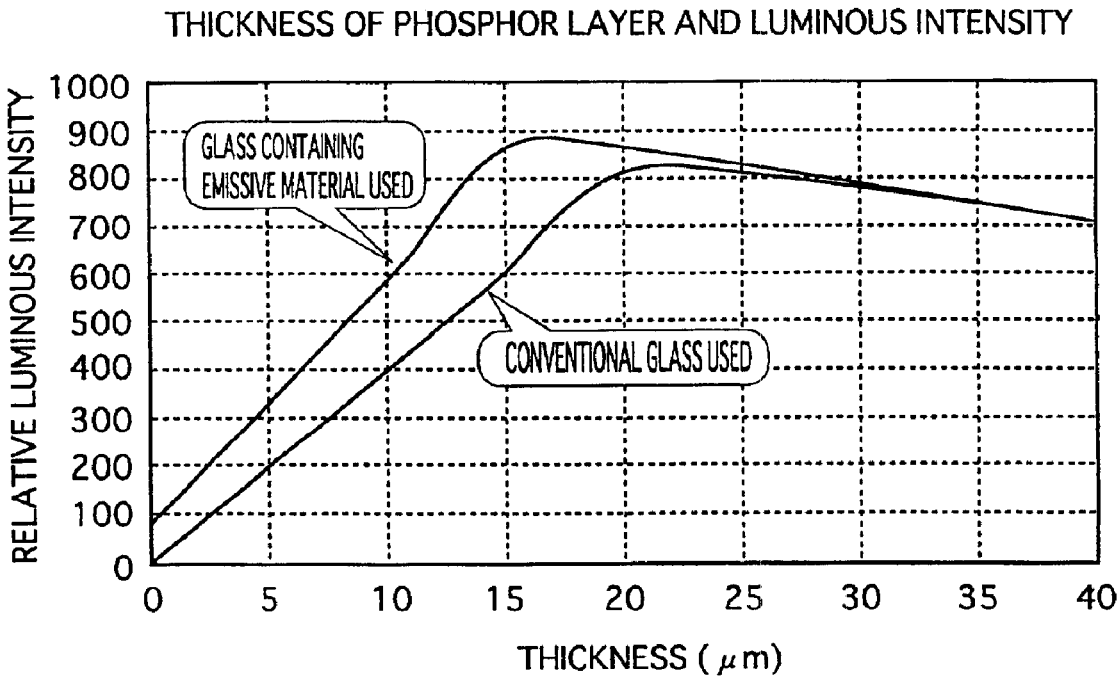
FIG. 8 is a characteristic graph showing the relation between phosphor layer thickness and relative luminous intensity.

FIG. 8 shows a characteristic graph showing the relation between the thickness of the phosphor layer and the relative luminous intensity.

In FIG. 8, the relative luminous intensity of the fluorescent lamp employing the general soda glass is the highest when the thickness of the phosphor layer is above 20 $\mu$m, whereas the relative luminous intensity of the fluorescent lamp employing the soda glass containing TlO is the highest when the thickness of the phosphor layer is below 20 $\mu$m.

The following can be found from the experimental results. While it is advantageous for general fluorescent lamps to set the thickness of the phosphor layer at 20 $\mu$m or more, it is advantageous for the fluorescent lamp relating to the present embodiment to set the thickness of the phosphor layer below 20 $\mu$m for increasing the luminous intensity.

[Second Embodiment]

Figure 9:
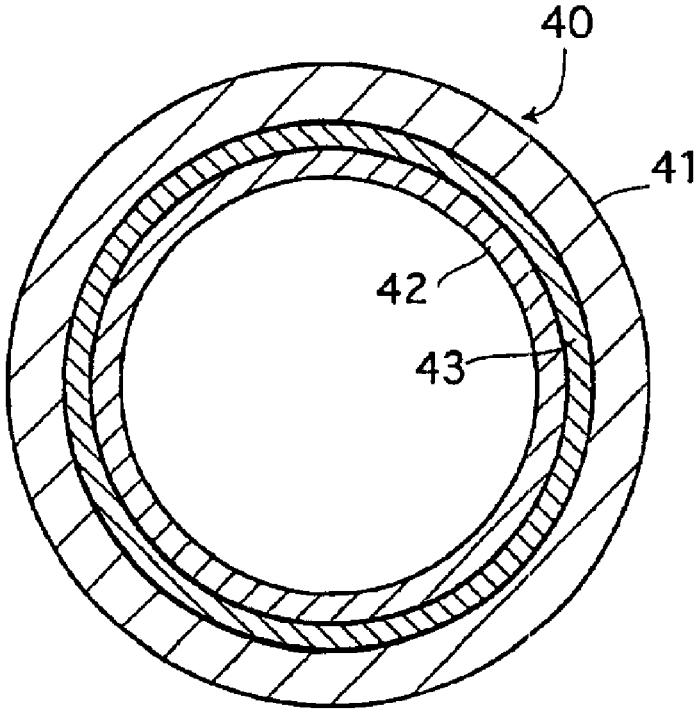
FIG. 9 shows a cross-sectional view of an arc tube of a fluorescent lamp relating to a second embodiment of the present invention.

FIG. 9 shows a cross-sectional view of the arc tube of the fluorescent lamp relating to the present embodiment.

The fluorescent lamp relating to the present embodiment has the same construction as the fluorescent lamp relating to the first embodiment of the present embodiment, with the only difference being in a fluorescent tube 40 employed instead of the fluorescent tube 10. In the fluorescent tube 40, a protective layer 43 is formed between a fluorescent layer 42 and a glass tube 41.

The protective layer 43 is a transparent layer that contains metallic oxide selected form the group consisting of zinc oxide (ZnO), titanium oxide ($TiO_2$), silicon oxide ($SiO_2$), and aluminum oxide ($Al_2O_3$) as a base material, and additionally contains an emissive element in a state of being melted in the base material.

Specific examples of emissive elements are oxides of elements (Ti, Zr, . . . ) listed in the first embodiment. Among these, the oxides of the elements in lanthanoide series, more particularly, oxides of Gd and Tb, are especially suitable for use in this case.

Note that the phosphor layer 42 is the same as the phosphor layer 12 in the first embodiment.

Note also that the glass tube 41 does not contain an emissive element.

The protective layer 43 is formed in the following way.

A powder material of an emissive element is mixed with a powder material of a metallic oxide that is a base material of the protective layer 43, and this mixed powder is melted and ground to form a mixed powder compound. This mixed powder compound is then added to a solvent such as an organic solvent (isopropyl alcohol) together with a dispersing agent, so that it is dispersed in the solvent. In this way, a coating liquid is prepared. This coating liquid is then applied to the inner surface of the gas tube 41 with a spray method or the like, dried, and baked, to form the protective layer 43.

By melting the emissive element into the base material of the protective layer 43 as described above, an oxide compound composed of metallic oxide (ZnO, $TiO_2$, $SiO_2$, or $Al_2O_3$) of the base material and metallic oxide of the emissive element is formed.

For applying the mixed powder to the inner surface of the glass tube 41, not only the wet method employed above but also an electrostatic spraying method, or a sol-gel method using a liquid obtained by dissolving alkoxide into an organic solvent may be employed.

As described above, the protective layer 43 which contains the emissive element can produce both the effect to improve the luminous flux maintenance factor due to the base material contained therein, and the effect to improve the luminous efficiency due to the emissive element contained therein.

The base material in the protective layer 43 makes it difficult for sodium to be diffused from the glass so as to be transmitted to the phosphor layer 12. Therefore, the protective layer 43 also produces the effect to increase the luminous flux maintenance factor, by preventing blackening which occurs in the phosphor layer 12 due to mercury reacting with sodium in the glass. Furthermore, the emissive element produces the effect to improve the luminous efficiency. As in the first embodiment, the improvement here is made not only in the luminous flux formed by visible light emitted due to ultraviolet light with the wavelength of 254 nm exciting the phosphors in the phosphor layer 42. Besides, the emissive element contained in the protective layer 43 emits light that forms other luminous fluxes, resulting in the luminous efficiency being improved.

To be more specific, ultraviolet light emitted due to the electric discharge within the fluorescent tube 40 is partially transmitted through the phosphor layer 42. The transmitted portion of the ultraviolet light illuminates the protective layer 43, exciting the emissive element contained in the protective layer 43. The excited emissive element emits near-ultraviolet light and visible light from the protective layer 43. Furthermore, the ultraviolet light emitted from the protective layer partially illuminates the phosphor layer 42. This portion of the ultraviolet light excites the phosphors in the phosphor layer 42 to emit visible light.

Also, since the emissive element is melted in the base material of the protective layer 43, the emissive element does never be an obstacle for the visible light to be transmitted through the protective layer.

Note that the effects of the emissive element to emit near-ultraviolet light and visible light can be produced because the emissive element is melted in the base material to form oxide compounds as described above. These effects are considered impossible when metallic oxide of the base material and metallic oxide of the emissive element are simply mixed in the form of particles.

The optimum range of the concentration of the emissive element in the protective layer 43 is the same as in the first embodiment. The optimum range for the oxides of the elements in the groups 4A, 5A, and 6A and the elements in lanthanoide series is 0.01 to 10 wt %, whereas the optimum range for the elements in the groups 3B, 4B, and 5B is 0.01 to 0.5 wt %.

The thickness of the protective layer 43 is preferably be set in the range of 1 to 30 $\mu$m.

Note that the present embodiment describes the case where the glass tube 41 does not contain the emissive element. However, as a modified example, the emissive element may be contained in both the protective layer 43 and the glass tube 41.

Also, an element such as $TiO_2$ has both the mercury transmission preventing effect and excitation emission effect, and therefore, a single use of $TiO_2$ might seem to produce the same effects produced by the present embodiment. However, with the single use of such an element, the excitation emission effect dramatically decreases due to a self-absorption property of the element. Furthermore, such single use of the element limits a method to form the protective layer because it limits material types that can be used to form the protective layer. On the contrary, with the combined use of the base material and the emissive element, the self-absorption of the emissive element can be reduced. Furthermore, in this case, many combinations of material types of the base material and material types of the emissive element are available. When determining the composition of the protective layer, the present invention is advantageous because it provides the wide selection of materials and of methods for forming the protective layer.

As a preferable combination, silicon oxide or aluminum oxide as the base material and gadolinium oxide and/or terbium oxide as the emissive element can be considered.

[Third Embodiment]

The present embodiment described the case where the present invention is applied to HID lamps, taking a fluorescent mercury lamp, a metal halide lamp, and a high-pressure sodium lamp for example.

Figure 10:
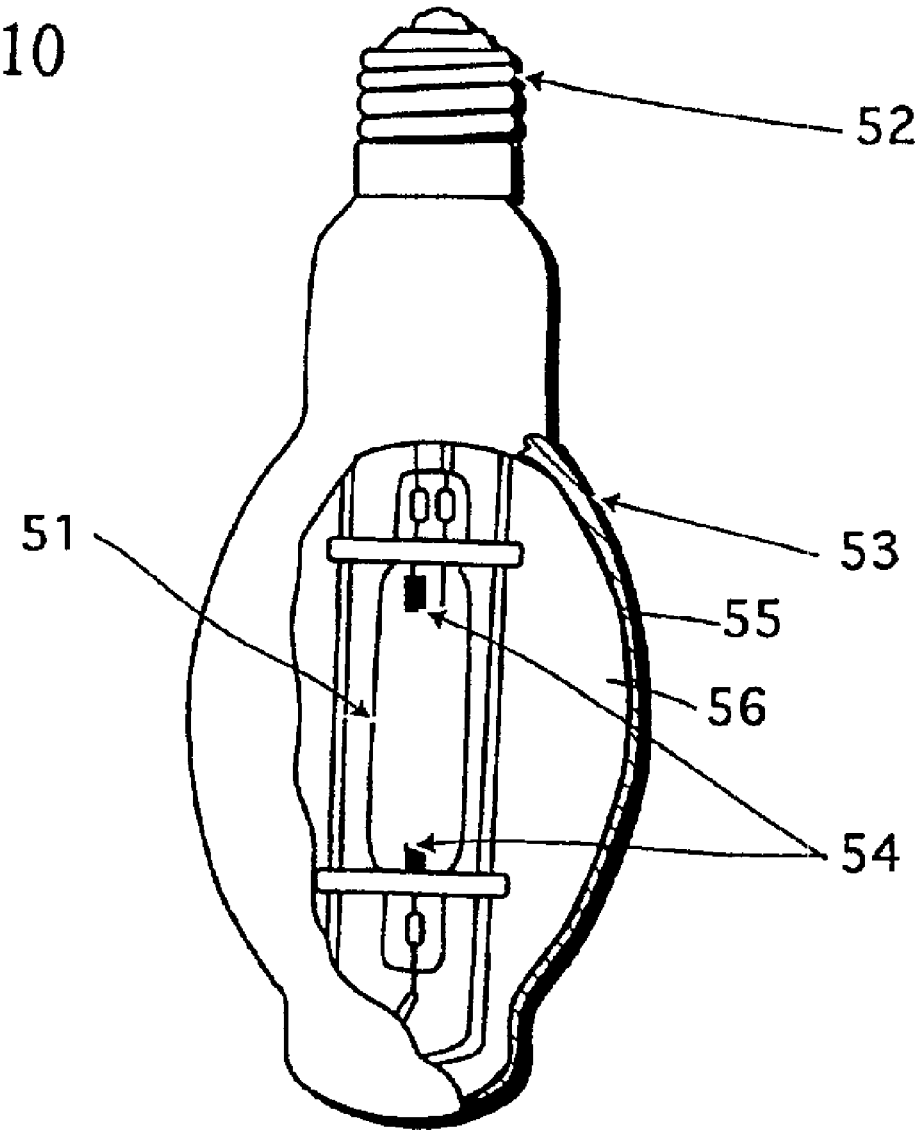
FIG. 10 shows a mercury fluorescent lamp relating to a third embodiment of the present invention.

FIG. 10 shows an example of the fluorescent mercury lamp.

The fluorescent mercury lamp is one type of a high-pressure mercury lamp, and is roughly composed of an arc tube 51, a base 52, and an envelop 53 as shown in the figure.

The arc tube 51 is made of transparent quartz glass, and is equipped with electrodes 54 at both ends. Inside the arc tube 51 are enclosed mercury and argon.

The envelop 53 is composed of a glass tube 55 provided so as to envelop the arc tube 51. The inner surface of the glass tube 55 is covered with the phosphor layer 56.

In the arc tube 51, the electric discharge under high pressure mercury vapor of 100 to 1000 kPa causes emission of visible light. Besides the visible light, ultraviolet light is emitted in the arc tube 51. The ultraviolet light illuminates the phosphor layer 56 in the envelop 53, exciting emission of visible light.

Here, the glass tube 55 of the envelop 53 is made of borosilicate glass in which at least one emissive element selected from the emissive elements mentioned in the first embodiment (oxides of Ti, Zr . . . ) is melted.

With this construction, the envelop 53 produces the same effects as the fluorescent tube 10 described in FIG. 3 in the first embodiment. More specifically, ultraviolet light emitted from the arc tube 51 is partially transmitted through the phosphor layer 56, and illuminates the glass tube 55. The emissive element contained in the glass tube 55 is excited by the transmitted portion of the ultraviolet light, emitting long wave ultraviolet light, and visible light. The ultraviolet light emitted form the glass tube 55 illuminates the phosphor layer 56, exciting emission of visible light.

With this effect, the fluorescent mercury lamp in the present embodiment is provided with the improved luminous efficiency compared to the case when the emissive element is not added to the glass tube.

Also, in the present embodiment, the emissive element is included not in the arc tube 51 made of quartz glass, but in the envelop 53 made of glass. This also helps improve the luminous efficiency of the fluorescent mercury lamp. This is because the emissive element converts ultraviolet light (with the peak wavelength of 254 nm) emitted due to mercury excitation into long wave ultraviolet light or visible light more efficiently when contained in the glass than when contained in the quartz glass. Furthermore, borosilicate glass contains such elements as aluminum oxide and boron oxide. These elements isolate the emissive element in the glass by surrounding it, and accordingly produce the effect to prevent the self-absorption of the emissive element.

The present embodiment describes the fluorescent mercury lamp which has the phosphor layer 56 provided in the envelop 53. However, the luminous efficiency of a high-pressure mercury lamp which does not have a phosphor layer in its envelop can also be improved to a certain level, by melting the above mentioned emissive element into the glass in the envelop. To be more specific, even when the phosphor layer is not provided in the envelop, the emissive element contained in the envelop is excited by ultraviolet light from the arc tube to emit visible light. In this case, too, superior luminous efficiency can be obtained compared to the case without the emissive element.

Figure 11A:
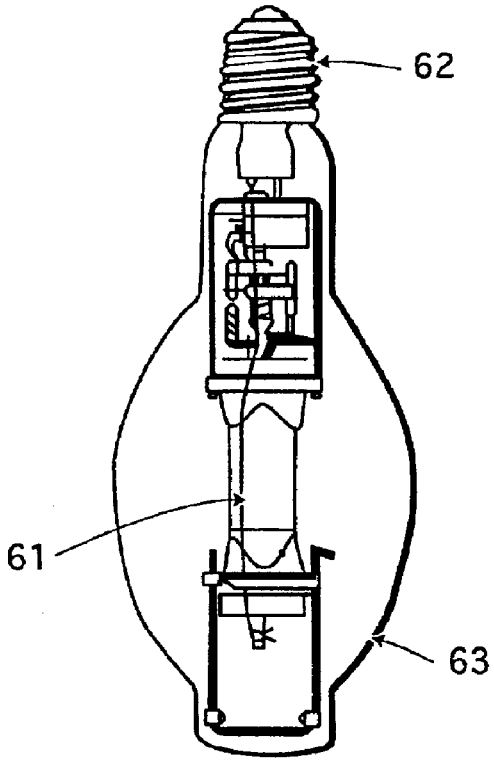
FIG. 11A shows a metal halide lamp relating to the third embodiment of the present invention.
Figure 11B:
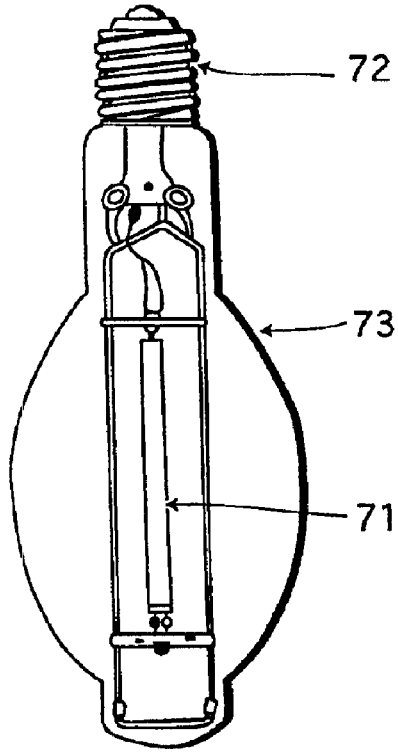
FIG. 11B shows a high-pressure sodium lamp relating to the third embodiment of the present invention.

The following explains the metal halide lamp and the high-pressure sodium lamp, with reference to FIGS. 11A and 11B.

FIG. 11A shows an example of the metal halide lamp.

The metal halide lamp is roughly composed of an arch tube 61 made of transparent quartz glass, a base 62, and an envelop 63 as the fluorescent mercury lamp described above. The metal halide lamp differs from the fluorescent mercury lamp as follows. Inside the arc tube 61 are enclosed not only metal halide (for example, halide of scandium (Sc) or sodium (Na)) as an emissive material but also a rare gas as a starting aid, and a buffer gas for maintaining electric characteristics and arc discharge at optimum temperatures. A phosphor layer is not formed in the envelop 63.

Note here that the envelop 63 is made of borosilicate glass in which at least one emissive element selected from the emissive elements mentioned in the first embodiment (oxides of Ti, Zr . . . ) is melted. In this metal halide lamp, with the electric discharge occurring in the arc tube 61, metal halide is dissociated into metallic atoms and halide atoms. The metallic atoms are then excited to emit visible light, resulting in a luminous flux being obtained.

Note that the electric discharge also causes ultraviolet light to be emitted in the electric discharge in the arc tube 61. The emissive element contained in the envelop 63 is exposed to the ultraviolet light and is excited to emit visible light. Due to this, the larger amount of luminous flux can be obtained compared to the case without the emissive element. That is to say, superior luminous efficiency of the metal halide lamp can be obtained.

FIG. 11B shows an example of the high-pressure sodium lamp.

The high-pressure sodium lamp is roughly composed of an arc tube 71, a base 72, and an envelop 73. The appearance of the high-pressure sodium lamp is similar to the fluorescent mercury lamp described above. However, the high-pressure sodium lamp differs from the fluorescent mercury lamp as follows. The arc tube 71 is formed by a polycrystal acuminate ceramics tube. Inside the arc tube 71 are enclosed not only sodium as an emissive material but also a xenon gas as a starting aid and mercury as a buffer gas. A phosphor layer is not formed in the envelop 73.

Here, the envelop 73 is made of soda glass in which at least one emissive element selected from the emissive elements mentioned in the first embodiment (oxides of Ti, Zr . . . ) is melted.

In this high-pressure sodium lamp, electric discharge under sodium vapor occurring in the arc tube 71 excites emission of visible light, resulting in a luminous flux being obtained.

Note that a small amount of ultraviolet light is also emitted form the arc tube 71. The ultraviolet light excites the emissive element contained in the envelop 73 to emit visible light. With this effect, the larger amount of luminous flux can be obtained compared to the case without the emissive element. That is to say, superior luminous efficiency of the high-pressure sodium lamp can be obtained.

[Fourth Embodiment]

The present embodiment described the case where the present invention is applied to an incandescence lamp.

Typical examples of incandescence lamps are a lamp for general-purpose illumination and a halide lamp.

The lamp for general-purpose illumination is equipped with a bulb made of soft soda glass or borosilicate glass. Inside the bulb are enclosed a rare gas (such as nitrogen, argon, or krypton) and provided electrodes made of a lead-in wire and a tungsten filament.

The halide lamp is equipped with a bulb generally made of quartz. Inside the bulb are enclosed a rare gas together with halogen, and provided electrodes made of a lead-in wire and a tungsten filament.

The incandescence lamp relating to the present embodiment is a lamp for general-purpose illumination or a halide lamp in which at least one emissive element selected from the emissive elements mentioned in the first embodiment (oxides of Ti, Zr . . . ) is melted into a glass material of its bulb.

More specifically, the emissive element is added to a glass material for forming a glass bulb, whereas the emissive element is added to $SiO_2$ for forming a quartz bulb.

Among the oxides of the elements listed above, the oxides of the elements in lanthanoide series are particularity suitable for use. The reason for this is that they emit relatively larger amount of light having wavelengths in a range where the sensibility of human eye is high (around 550 nm) as described in the above embodiment.

In the incandescent lamp in the present embodiment, basically, electric power passing through the electrodes heats up the filament, causing visible light to be emitted. In this way, a luminous flux can be obtained as in conventional incandescent lamps. Here, a small amount of ultraviolet light is also emitted. In the present embodiment, the ultraviolet light excites the emissive element contained in the bulb, to emit visible light. Due to this visible light, the larger amount of luminous flux and accordingly superior luminous efficiency can be obtained, compared to the case without the emissive element. It should be noted that this effect is considered larger when the emissive element is added to the glass bulb rather than to the quartz bulb.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A fluorescent lamp comprising:

a fluorescent tube that is composed of a glass tube having a phosphor layer formed on an inner surface thereof and mercury and a rare gas enclosed therein; and electrodes that cause an electrical discharge within the fluorescent tube, wherein the glass tube is made of a glass material that contains an emissive element mixed within the glass material, the emissive element emitting, when exposed to first ultraviolet light that is emitted due to mercury excitation, second ultraviolet light that has a longer wavelength than the first ultraviolet light.

2. The fluorescent lamp of claim 1, wherein the emissive element emits visible light together with the second ultraviolet light, when exposed to the first ultraviolet light.

3. The fluorescent lamp of claim 1, wherein an entire luminous flux emitted from the fluorescent lamp includes:

a first luminous flux that is formed by visible light emitted from the phosphor layer when exposed to the first ultraviolet light;

a second luminous flux that is formed by visible light emitted from the emissive element when exposed to the first ultraviolet light; and a third luminous flux that is formed by visible light emitted from the phosphor layer when exposed to the second ultraviolet light, wherein the second luminous flux and the third luminous flux together constitute at least 2% of the entire luminous flux emitted from the fluorescent lamp.

4. The fluorescent lamp of claim 1, wherein a thickness of the glass tube is 0.62 mm or less.

5. The fluorescent lamp of claim 1, wherein a thickness of the phosphor layer is below 20 $\mu$m.

6. A fluorescent lamp comprising:

a fluorescent tube that is composed of a glass tube having a phosphor layer formed on an inner surface thereof and mercury and a rare gas enclosed therein; and electrodes that cause an electrical discharge within the fluorescent tube, wherein the glass tube is made of a glass material containing an oxide mixed within the glass material, the oxide including at least one element selected from the group consisting of titanium, zirconium, vanadium, niobium, tantalum, molybdenum, tungsten, thallium, stannum, plumbum, bismuth, lanthanum, cerium, praseodymium, neodymium, samarium, europium, gadolinium, terbium, dysprosium, holmium, erbium, thulium, ytterbium, and lutetium.

7. The fluorescent lamp of claim 6, wherein the glass material contains 0.01 wt % to 10 wt % of an oxide of at least one element selected from the group consisting of titanium, zirconium, vanadium, niobium, tantalum, molybdenum, tungsten, lanthanum, cerium, praseodymium, neodymium, samarium, europium, gadolinium, terbium, dysprosium, holmium, erbium, thulium, ytterbium, and lutetium.

8. The fluorescent lamp of claim 6, wherein the glass material contains 0.01 wt % to 0.5 wt % of an oxide of at least one element selected from the group consisting of thallium, stannum, plumbum, and bismuth.

9. A fluorescent lamp comprising:

a fluorescent tube having a protective layer formed on an inner surface thereof, a phosphor layer formed on the protective layer, and mercury and a rare gas enclosed therein; and electrodes that cause an electrical discharge within the fluorescent tube, wherein the protective layer contains an oxide of at least one emissive element selected from the group consisting of zirconium, vanadium, niobium, tantalum, molybdenum, tungsten, thallium, stannum, plumbum, bismuth, praseodymium, neodymium, samarium, gadolinium, dysprosium, holmium, erbium, thulium, ytterbium, and lutetium.

10. The fluorescent lamp of claim 9, wherein an entire luminous flux emitted from the fluorescent lamp includes:

a first luminous flux that is formed by visible light emitted from the phosphor layer when exposed to the first ultraviolet light;

a second luminous flux that is formed by visible light emitted from the emissive element when exposed to the first ultraviolet light; and a third luminous flux that is formed by visible light emitted from the phosphor layer when exposed to the second ultraviolet light, wherein the second luminous flux and the third luminous flux together constitute at least 2% of the entire luminous flux emitted from the fluorescent lamp.

11. The fluorescent lamp of claim 9, wherein the protective layer contains 0.01 wt % to 10 wt % of an oxide of at least one element selected from the group consisting of zirconium, vanadium, niobium, tantalum, molybdenum, tungsten, praseodymium, neodymium, samarium, gadolinium, dysprosium, holmium, erbium, thulium, ytterbium, and lutetium.

12. The fluorescent lamp of claim 9, wherein an entire luminous flux emitted from the fluorescent lamp includes:

a first luminous flux that is formed by visible light emitted from the phosphor layer when exposed to ultraviolet light that is emitted due to mercury excitation;

a second luminous flux that is formed by visible light emitted from an emissive element contained in the protective layer when exposed to ultraviolet light that is emitted due to mercury excitation; and a third luminous flux that is formed by visible light emitted from the phosphor layer when exposed to ultraviolet light that is emitted from the emissive element when exposed to ultraviolet light that is emitted due to mercury excitation, and wherein the second luminous flux and the third luminous flux together constitute at least 2% of the entire luminous flux emitted from the fluorescent lamp.

13. A high intensity discharge lamp comprising:

an arc tube in which an emissive material is enclosed, the emissive material emitting visible light and ultraviolet light when excited by an electric discharge; and an envelop whose one surface surrounding the arc tube is covered with a phosphor layer, wherein the envelop is made of a glass material that contains an emissive protective layer, the emissive protective layer emitting, when exposed to first ultraviolet light that is emitted due to excitation of the emissive material by the electric discharge, second ultraviolet light that has a longer wavelength than the first ultraviolet light.

14. The high intensity discharge lamp of claim 13, wherein the emissive protective layer emits visible light together with the second ultraviolet light when exposed to the first ultraviolet light.

15. The high intensity discharge lamp of claim 13, wherein an entire luminous flux emitted from the high intensity discharge lamp includes:

a first luminous flux that is formed by the visible light emitted due to the excitation of the emissive material by the electric discharge;

a second luminous flux that is formed by visible light emitted from the emissive protective layer when exposed to the first ultraviolet light; and a third luminous flux that is formed by visible light emitted from the phosphor layer when exposed to the second ultraviolet light.

16. A high intensity discharge lamp comprising:

an arc tube in which an emissive material is enclosed, the emissive material emitting visible light and ultraviolet light when excited by an electric discharge; and an envelop whose one surface surrounding the arc tube is covered with a phosphor layer, wherein the envelop is made of a glass material that contains an oxide mixed within the glass material, the oxide including at least one element selected from the group consisting of titanium, zirconium, vanadium, niobium, tantalum, molybdenum, tungsten, thallium, stannum, plumbum, bismuth, lanthanum, cerium, praseodymium, neodymium, samarium, europium, gadolinium, terbium, dysprosium, holmium, erbium, thulium, ytterbium, and lutetium.

17. A high intensity discharge lamp comprising:

an arc tube in which an emissive material is enclosed, the emissive material emitting visible light and ultraviolet light when excited by an electric discharge; and an envelop that is provided so as to envelop the arc tube, wherein the envelop is made of a glass material that contains an emissive protective layer, the emissive protective layer emitting visible light, when exposed to ultraviolet light that is emitted due to excitation of the emissive material by the electric discharge.

18. The high intensity discharge lamp of claim 17, wherein an entire luminous flux emitted from the high intensity discharge lamp includes:

a first luminous flux that is formed by the visible light emitted due to the excitation of the emissive material by the electric discharge; and a second luminous flux that is formed by visible light emitted from the emissive protective layer when exposed to the ultraviolet light that is emitted due to the excitation of the emissive material by the electric discharge.

19. A high intensity discharge lamp comprising:

an arc tube in which an emissive material is enclosed, the emissive material emitting visible light and ultraviolet light when excited by an electric discharge; and an envelop that is provided so as to envelop the arc tube, wherein the envelop is made of a glass material that contains an oxide mixed within the glass material, the oxide including at least one element selected from the group consisting of titanium, zirconium, vanadium, niobium, tantalum, molybdenum, tungsten, thallium, stannum, plumbum, bismuth, lanthanum, cerium, praseodymium, neodymium, samarium, europium, gadolinium, terbium, dysprosium, holmium, erbium, thulium, ytterbium, and lutetium.

20. A fluorescent lamp comprising:

a fluorescent tube having a protective layer formed on an inner surface thereof, a phosphor layer formed on the protective layer, and mercury and a rare gas enclosed therein; and electrodes that cause an electrical discharge within the fluorescent tube, wherein the protective layer contains an oxide of at least one element selected from the group consisting of titanium, zirconium, vanadium, niobium, tantalum, molybdenum, tungsten, thallium, stannum, plumbum, bismuth, praseodymium, neodymium, samarium, gadolinium, dysprosium, holmium, erbium, thulium, ytterbium, and lutetium, wherein the protective layer contains 0.01 wt % to 0.5 wt % of an oxide of at least one element selected from the group consisting thallium, stannum, plumbum, and bismuth.

21. A fluorescent lamp comprising:

a fluorescent glass tube;

a phosphor layer formed on an inner surface of the glass tube;

mercury enclosed within the glass tube;

a gas enclosed within the glass tube having a characteristic of enabling the mercury excitation for emitting a first ultraviolet light when excited by an electrical discharge, the first ultraviolet light exciting the phosphor layer to emit a first visible luminous flux for transmission through the fluorescent glass tube;

electrodes within the fluorescent glass tube for causing the electrical discharge; and an emissive protective layer embedded within the fluorescent glass tube having a characteristic of emitting a second visible luminous flux within the fluorescent glass tube when activated by the first ultraviolet light, while permitting transmission of at least a portion of the first visible luminous flux and the second visible luminous flux to an exterior of the fluorescent glass tube.

22. The fluorescent lamp of claim 21, wherein the emissive protective layer further has a characteristic of emitting a second ultraviolet light when activated by the first ultraviolet light, the second ultraviolet light activates the phosphor light to emit a third visible luminous flux to the exterior of the fluorescent glass tube.

23. The fluorescent lamp of claim 22, wherein the emissive protective layer includes an oxide of at least one element selected from the group consisting of titanium, zirconium, vanadium, niobium, tantalum, molybdenum, tungsten, thallium, stannum, plumbum, bismuth, lanthanum, cerium, praseodymium, neodymium, samarium, europium, gadolinium, terbium, dysprosium, holmium, erbium, thulium, ytterbium, and lutetium.

* * * * *